United States Patent [19]

Klingelhofer

[11] Patent Number: 5,077,533

[45] Date of Patent: Dec. 31, 1991

[54] CATHODE RAY TUBE DEFLECTION YOKE ARRANGEMENT

[75] Inventor: Fredric G. Klingelhofer, Des Plaines, Ill.

[73] Assignee: Syntronic Instruments, Inc., Addison, Ill.

[21] Appl. No.: 590,156

[22] Filed: Sep. 28, 1990

[51] Int. Cl.[5] ..... H01F 5/00

[52] U.S. Cl. ..... 335/213; 335/210; 313/426

[58] Field of Search ..... 335/210, 213; 313/426, 313/421, 428

[56] References Cited

U.S. PATENT DOCUMENTS

| | | | |
|---|---|---|---|
| 4,197,487 | 4/1980 | Takenaka et al. | 335/212 |
| 4,329,671 | 5/1982 | Gross et al. | 335/213 |
| 4,376,924 | 3/1983 | Gross et al. | 335/210 |
| 4,390,815 | 6/1983 | Key et al. | 315/368 |
| 4,654,615 | 3/1987 | McGlashan | 335/211 |
| 4,654,616 | 3/1987 | Dodds et al. | 335/212 |
| 4,823,100 | 4/1989 | Bruey | 335/210 |

FOREIGN PATENT DOCUMENTS

| | | | |
|---|---|---|---|
| 62-281243 | 12/1987 | Japan | 335/213 |

OTHER PUBLICATIONS

Article entitled, "Design of a NS-Pin Corrected 110° COTY Yoke for CRTs with Very Flat Faceplates", by B. Dasgupta, G.E. Consumer Electronics, Indianapolis, In., SID 1987 Digest.

Article entitled, "Relationship Between Raster Distortions, Screen Geometry and Winding Distribution of Deflection Yoke in a CRT Display System", by B. Dasgupta, RCA Consumer Electronics Division, Indianapolis, In., proceedings of the SID Vol. 26 1, 1985.

Article entitled, "Recent Advances in Electron Beam Deflection", by Edward F. Ritz, Jr., Tekronix, Inc., Beaverton, Ore., from Advances in Electronics and Electron Physics, vol. 49, 1979.

Article entitled, "Anastigmatic Yoke", by K. Schlesinger, pp. 102–107, from Electronics, dated, Oct. 1949.

Article entitled, "A Relation Between $H_O(z)$ and $H_2(z)$ in Deflection Yokes and Its Influence on Convergence Errors", by J. Gerber, RCA Laboratories, Princeton, N.J., pp. 273–277, Proceedings of the SID, vol. 26, 4/1985.

Article entitled, "Fifth-Order Trilemma in Deflection Yoke Design", by A. Sluyterman, Philips Display Systems Development Laboratory, Eindhoven, The Netherlands, Proceedings of the SID, Vol. 28, 1/1987.

*Primary Examiner*—George Harris

*Attorney, Agent, or Firm*—Fitch, Even, Tabin & Flannery

[57] ABSTRACT

A deflection yoke for a cathode ray tube, including a first yoke portion and a second yoke portion engaged with opposite sides of the cathode ray tube neck. Each yoke portion includes a main winding for producing substantial first and associated higher harmonic magnetic fields in the neck and a correction winding for producing substantial third and higher harmonic fields. The correction winding is formed by running normally screen end transverse main winding turns longitudinally with the neck toward the cathode ray tube gun end in one yoke portion quadrant and returning them to the screen end transverse main winding in the other yoke portion quadrant.

5 Claims, 2 Drawing Sheets

CATHODE RAY TUBE DEFLECTION YOKE ARRANGEMENT

BACKGROUND OF THE INVENTION

This invention relates to deflection yokes for cathode ray tube display systems, and particularly to such yokes which introduce raster correcting non-linearity to the deflection causing magnetic fields.

The production of an accurate video image on a cathode ray tube (CRT) depends on an accurate scanning , raster on the CRT screen. CRT rasters are subject to many types of inaccuracies such as: pincushion, barrel, cupids bow (mustache or seagull), keystoning, and so on. Many of the geometric distortions can be eliminated by introducing the proper non-uniformities into the beam deflecting magnetic field shape or by driving the deflection yoke with non-linear sweep controlling signals. Nonlinear driving circuitry has met with only limited success however, since modifying the sweep signal generation circuitry to produce the needed non-uniform sweep signals adds to its expense and limits the specially designed driving circuitry to driving perhaps a single yoke and CRT combination. Such limitation of usage is significant with today's design methodologies where circuit modules are typically designed to be compatible with many types of related circuit arrangements to reduce design expense.

Another type of raster correction solution is to add fixed components such as permanent magnets or permeable pole pieces to the deflection yoke which constantly distort any applied magnetic field. The addition of such components is only an approximate solution and makes the yoke to which they are attached physically large and complex. Permeable pole pieces made of electrically conductive material are influenced by scan frequency, and permanent magnets must have a field strength selected for a given CRT anode voltage.

Accurate rasters can be produced by deflection yokes which are wound so that they produce required nonlinear deflection magnetic fields when they are driven by standard sweep signals. Nonlinear yokes are a preferred method of raster correction since they are compatible with standard sweep generation circuitry and they need only be somewhat more physically complex than linear yokes.

Yokes which produce non-uniform deflection fields do so by adding amounts of third, fifth or higher harmonic corrections to the deflection field. As the deflection angle, "squareness" and flatness of CRTs increases in keeping with consumer demand, the amount of required higher harmonic correction relative to the first harmonic increases substantially. In fact, the amount of such correction called for in modern CRTs frequently requires that the current flow direction in the deflection yoke turns used to create the higher harmonics must be opposite to the direction of current flow through the main coils in the same yoke quadrant. No acceptable yoke arrangement exists for producing such coil turns having a reversed current flow.

One known attempt to provide current flow opposite to that of a main winding is described in an article by B. B. Dasgupta in the 1987 S.I.D. Digest. With the arrangement described by Dasgupta an auxiliary coil which was energized in reverse of a main coil was added to provide horizontal turns at particular angular locations about the yoke. The addition of the auxiliary coil permitted turns of reversed current flow, but it added a full coil of conductors and reduced the inductance to resistance (L/R) ratio of the yoke so significantly that unacceptable scan non-linearity occurred.

It is an object of the present invention to provide a deflection yoke which permits the introduction of opposite direction current flow to that of a main winding at controlled locations about a deflection yoke and which does not decrease the L/R ratio of the yoke to unacceptable levels.

SUMMARY OF THE INVENTION

The present invention is directed to a deflection yoke arrangement in which correction turns are provided by extending the length of the main winding turns which normally run transverse to the neck of a CRT at the screen end of the yoke and running the extended turns longitudinally along the neck of the CRT toward the gun end of the yoke in one quadrant, and returning the extended turns to the screen end of the yoke in the other quadrant. The extended turns remain serially connected to the main windings of the yoke. In each quadrant, the main turns provide the necessary first and associated higher harmonic deflection field while the extended turns, connected in series therewith, provide reversed current flow to produce the desired modification of higher harmonic field distortions.

Extending the screen end transverse turns to provide the correction turns permits their accurate placement within the yoke and avoids the addition of a separate complete coil or coils for correction, thereby avoiding the substantial increase in resistance caused by such a complete correction coil. When the main coil winding comprises n conductor turns and the correction winding comprises m conductor turns, the use of a complete coil to provide correction results in $2m+2n$ transverse turns to connect the longitudinal turns of the yoke. Use of the present invention provides desirable magnetic field correction with a number of transverse turns substantially equal to 2n thereby reducing the amount of resistance producing conductor required for the yoke. Correction turns of the type disclosed herein can be incorporated into any deflection yoke in which the deflection magnetic field is developed by turns running longitudinal to a CRT neck such as the well known stator-type yokes and saddle-type yokes.

A deflection arrangement in a preferred embodiment of the present invention comprises a source of deflection signals connected to a deflection yoke comprising a pair of windings engaged opposite one another on the neck portion of a CRT. Each of the windings consists of a main winding having at least two spaced apart longitudinal sections engaged along the length of the CRT neck for creating a substantially first harmonic with associated higher harmonic magnetic field through the CRT neck and both gun end and screen end transverse sections connecting the two longitudinal sections. Correction for third and higher harmonic nonuniformities of the magnetic field are provided by an additional winding. The additional winding has a plurality of turns each connected in series with one turn of the main winding and extending from the screen end transverse section to a predetermined point and returning from that predetermined point to the screen end of transverse section such that no turn of the additional winding crosses itself.

DETAILED DESCRIPTION OF THE PREFERRED EMBODIMENT

Figure 1:
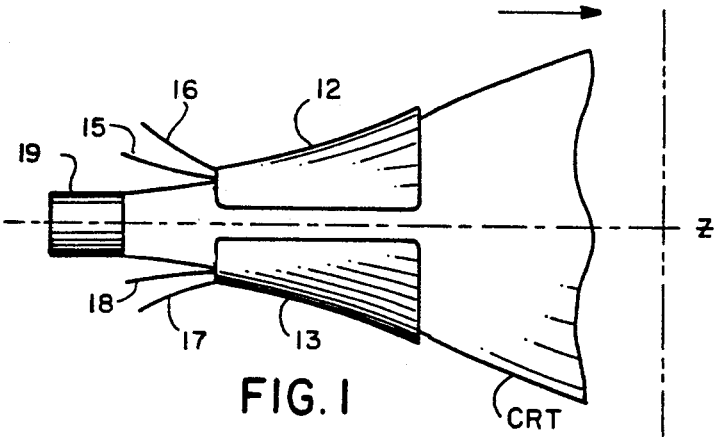
FIG. 1 is a side view of a cathode ray tube and deflection yoke arrangement of an embodiment of the invention.

FIG. 1 is a side plan view of the neck portion of a CRT having attached thereto a horizontal deflection portion of a deflection yoke comprising a top deflection coil 12 and a bottom deflection coil 13. The inner surfaces of the top and bottom deflection coils 12 and 13 form a surface of a rotation (flared horn in the present embodiment) about the Z axis of the CRT. By means well known in the art, the application of a control voltage between conductors 15 and 16 of coil 12 and 17 and 18 of coil 13 produces a magnetic field in the CRT neck which controls the point at which electrons from electron gun 19 strike the screen (not shown) of the CRT.

Figure 2:
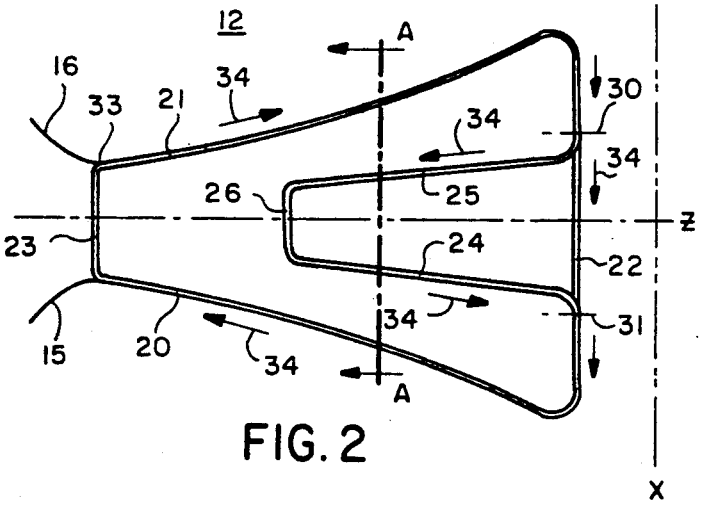
FIG. 2 is a top plan view showing a portion of the yoke of FIG. 1.

FIG. 2 is a top plan view showing a coil 12 and representing the structure of coil 13. Deflection coil 12 includes a main winding portion for establishing, in conjunction with deflection coil 13, the essentially two pole (first harmonic) magnetic field for beam deflection and an additional winding (called a correction winding) to provide controlled non-linearity in the overall beam deflection magnetic field. The deflection coil 12 is formed by a plurality of serially wound turns of a conducting medium. In the present embodiment, the conducting medium is a single strand of wire, however, other types of conducting media such as stranded wire or stranded/insulated wire (Litz wire) can also be used as will be readily apparent.

The magnetic field produced by a main winding includes some associated third and higher harmonic magnetic field components. The controlled non-linearity provided by the correction winding may augment or diminish the third and higher harmonic components of the magnetic field produced by the main winding, depending on the placement of the correction windings on the CRT neck and their number of turns. Both augmenting and diminishing are referred to herein as modification of the harmonics.

The main winding of deflection coil 12 comprises longitudinal sections 20 and 21, each of which is made from n turns of wire running longitudinally to the CRT neck. As used herein the term "longitudinal" means formed for engagement with the neck and rear bulb of a CRT and running substantially in line between the gun end of the CRT and the screen end, as opposed to running across the neck of a CRT.

The individual turns of longitudinal sections 20 and 21 are serially connected at the gun end 19 of the yoke by a first transverse section 23 also comprising n turns. The correction winding of deflection coil 12 comprises a third and fourth longitudinal section 24 and 25 to provide controlled non-linearity in the magnetic fields of the CRT neck. Each longitudinal correction winding 24 and 25 comprises m-turns and is connected to the other longitudinal correction winding by a transverse section 26 of m-turns. Deflection coil 12 also includes a transverse section 22 of n-m turns extending from a point 30 to a point 31 to connect n-m conductors of longitudinal section 21 to the same number of conductors in longitudinal section 20.

The coil 12 is series wound from a single conductor connected between energizing conductors 15 and 16. Two types of turns are used to build coil 12. The first type is a main winding turn which starts, for example, at point 33 and runs around the perimeter sections 21, 22, 20 and 23 of coil 12 in a clockwise direction in FIG. 2. The second type of turn is used in the correction winding. Each of the second type turns adds to the main winding through longitudinal sections 20 and 21 and also forms the correction winding. Again, starting from point 33 the correction winding turns run along section 21 to point 30 where they continue to form sections 25, 26 and 24 in sequence. At point 31, the second type of turn continues in a clockwise direction along sections 20 and 23 back to point 33. When a signal of a first polarity is applied between energizing conductors 15 and 16, a current I flows through each conductor of each coil section in the direction of arrow 34.

The longitudinal sections 20, 21, 24 and 25 are used to create the deflection controlling field of this embodiment. To be considered longitudinal, a section runs substantially along the neck of the CRT rather than transverse to it. Depending on the type of field to be produced, these longitudinal sections may include some transverse displacement but this is minor when compared to the displacement along the Z axis.

Figure 3:
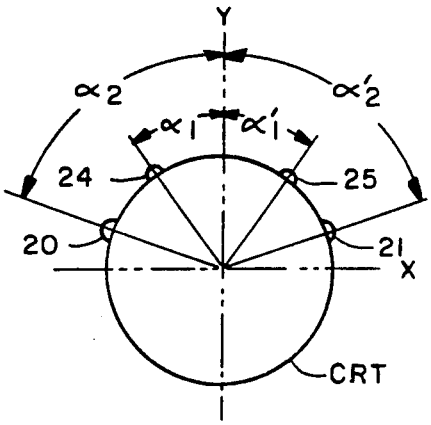
FIG. 3 is a section taken through the CRT neck and yoke combination of FIG. 2.

FIG. 3 shows a section of the CRT neck and deflection coil 12 taken at section A—A of FIG. 2. In FIG. 3 the longitudinal sections are labelled 20, 21, 24 and 25 as they are in FIG. 2. Longitudinal sections 20 and 21 are spaced around the CRT neck at substantially the same angle $\alpha 2$ and $\alpha' 2$ from the X axis to create a symmetrical field. Similarly, sections 24 and 25 are each displaced from the Y axis by angles $\alpha l$ and $\alpha' l$ which are substantially equal. The amount of magnetic field modification provided by correction winding sections 24 and 25 can be varied by changing the angles $\alpha l$ and $\alpha' l$ and by changing the number of turns in these winding sections.

Figure 4:
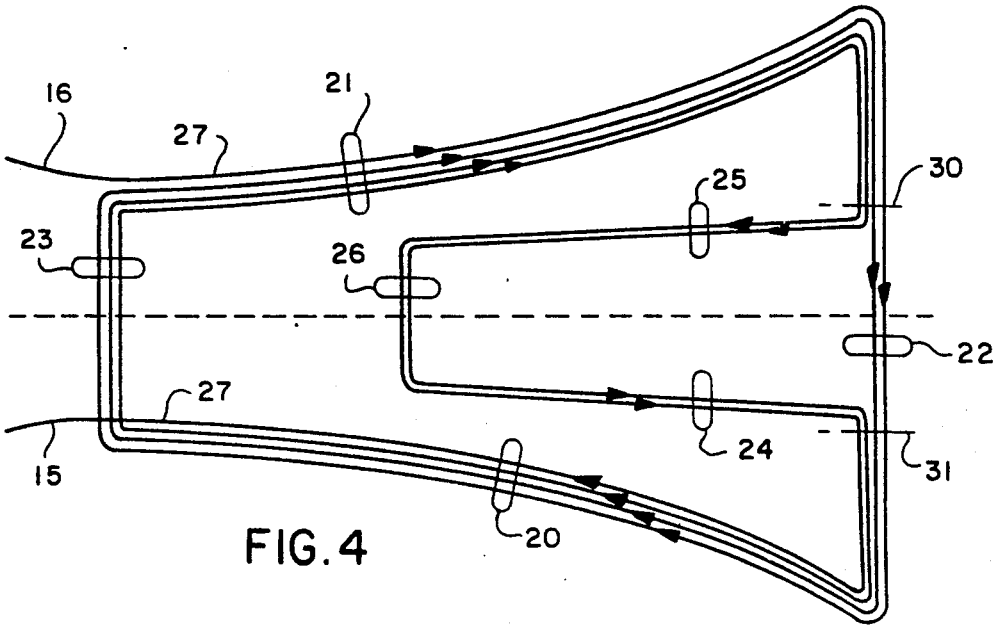
FIG. 4 is a top plan view of the single conductor layout producing a four turn yoke portion of the type shown in FIG. 2.

FIG. 4 shows a coil 12 of the type shown in FIG. 2 in which the main winding sections 20 and 21 comprise four conductor turns and the correction winding sections 24 and 25 comprise two winding turns. Although FIG. 4 shows the use of a small number of total turns, the principles illustrated thereby can be readily applied to produce yokes having far larger numbers of turns. The direction of the arrowheads on the conductor 27 of FIG. 4 show the direction of current flow when a voltage of a given polarity is applied between energizing conductors 15 and 16. The single conductor 27 starts from energizing conductor 16 and runs clockwise around the outer perimeter of the yoke for two complete circuits. Conductor 27 then runs to the screen end of the yoke and along the screen end transverse section to a point 30 where it proceeds along section 25 of the correction winding, transverse to the CRT neck to form section 26 and returns along section 24 to the screen end transverse section at point 31. From point 31, conductor 27 again continues around the outer perimeter to point 30 where it provides a second turn to the correction winding, then follows the outer perimeter of the yoke to energizing winding 15. As can be seen in FIG. 4, each of the longitudinal sections 20 and 21 of the main winding comprise four conductor turns. The correction winding comprising sections 24, 25 and 26 comprises two conductor turns and the portion of screen end transverse winding 22 between sections 24 and 25 comprises two conductor turns.

When a signal of the first polarity is applied between energizing conductors 15 and 16, a current I flows through each conductor turn of each section in the direction of the arrows. Longitudinal section 21 comprises four conductors, each conveying the current I from the gun end toward the screen; section 25 comprises two conductors, each conveying current I in the opposite direction from the screen end to the gun end; section 24 comprises two conductor turns, each conveying the current I from transverse section 26 toward the screen; and section 20 comprises 4 conductor turns, each conveying the current I from the screen end of section 20 toward the gun end. The correction winding consisting of sections 25, 26 and 24 provides a predetermined current flow in reverse of that provided by the main field producing coils of sections 21, 22, 20 and 23.

FIG. 2 is a simplified view of a deflection coil presented for ease of understanding principles of the present invention. The main winding consisting of sections 20, 21, 22 and 23 could be saddle-wound to control the magnetic field produced by the main winding. Alternatively, the main winding longitudinal sections could consist of a plurality of separated sections placed around the neck of the CRT in what is called a stator-winding technique. As long as a main winding includes a screen end transverse section, one or more correction coils can be easily formed, as described above, by "pulling down" a number of screen end transverse turns at predetermined points along the screen end transverse section.

Determining the exact number of individual coil turns and their placement around the CRT neck required to produce the necessary first and higher harmonic fields for a given CRT is a complicated procedure and is not discussed in detail herein. Initially the CRT attributes are determined and, based on the attributes, computerized mathematical solutions which estimate winding densities and positions are sought. Based on such estimates, yokes are produced and modifications for the yoke are empirically determined. Thus, a yoke will tend to take shape using defined mathematical techniques and the skills of the expert designing the yoke.

Figure 5:
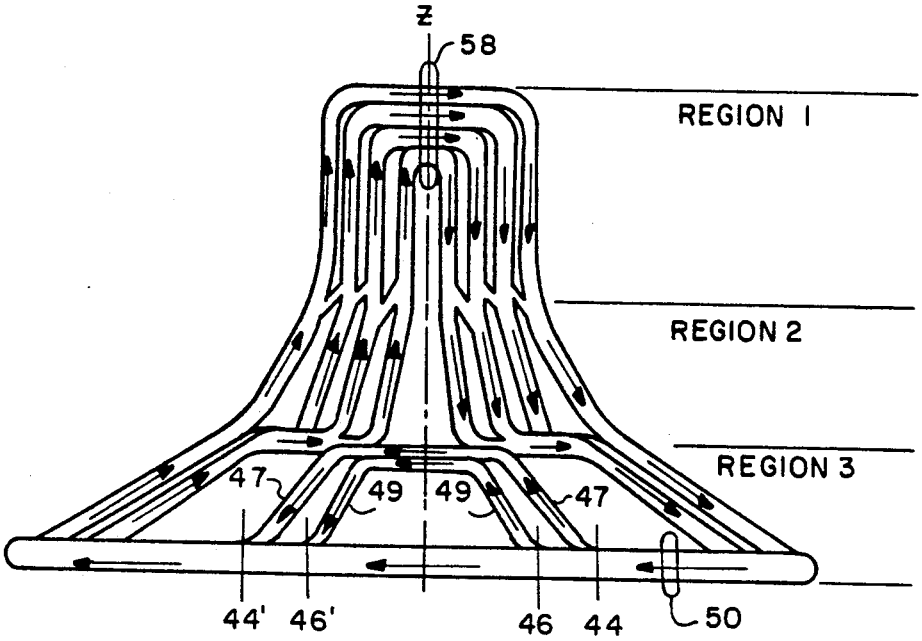
FIG. 5 is a top plan view of a horizontal yoke for a 110 monochrome cathode ray tube.
Figure 6:
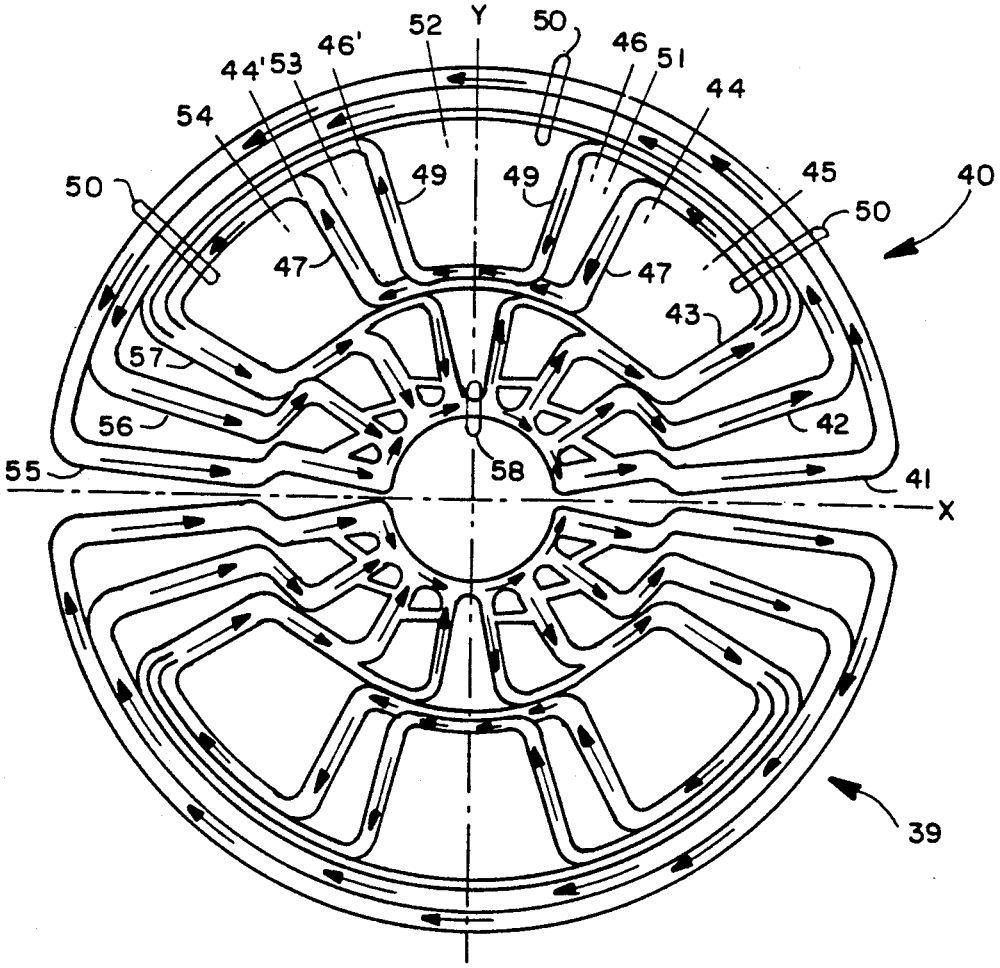
FIG. 6 is a gun end plan view of the yoke of FIG. 5.

FIGS. 5 and 6 show a top view and a gun end view respectively, of a stator wound yoke used to control horizontal sweep for a 110 monochrome CRT of the full square type. This yoke is presented to show application of the principles discussed with regard to FIGS. 2 through 4.

The yoke of FIG. 5 consists of three basic regions along its longitudinal axis labelled region 1, region 2, and region 3. The overall shape of the yoke and the pattern of yoke sections is different from region to region. The shape of each region is controlled by the geometry of the CRT to which the region is to be engaged and by the different electromagnetic function of each region. Region 3 is engaged with the bulbous back part of the CRT and is used, in addition to its sweep controlling function, to provide pin cushion correction. In providing pin cushion correction, however, the electron beam is elongated along the X axis shown in FIG. 6. The region 2 engages a smaller portion of the CRT neck and is intended to compensate for added pincushion distortion introduced in region 1 and to slightly elongate the electronic beam in the X direction of FIG. 6. Region 1 engages the more cylindrical part of the CRT neck and provides initial elongation in the Y axis direction to pre-compensate the X elongation of regions 2 and 3. An electron beam from the gun is elongated along the Y axis in the first region, which elongation is reduced in region 2. Region 3 then further elongates the electron beam along the X axis while reducing the Y axis dimension. The net result is a relatively round electron spot on the CRT screen and a pin cushion adjusted raster.

The magnetic field creating sections of the yoke are best seen in FIG. 6. The yoke of FIG. 6 comprises an upper coil shown at 40 and a lower coil shown at 39 which are substantially identical to one another. Only upper coil 40 is discussed in detail herein. In the right hand quadrant, upper coil 40 comprises three main winding longitudinal sections 41, 42 and 43 which have 11, 7 and 7 conductor turns, respectively. The turns for all three combine at the screen end of the yoke to run in parallel via section 50 transverse to the axis Z of the CRT. Section 50 at line 45 thus includes 25 conductor turns. Three of the 25 transverse turns of winding 50 are separated at a point 44 and run longitudinally back toward the gun end of the yoke to form a first correction winding 47 and three additional turns are separated at a point 46 and run back longitudinally toward the gun end of the yoke to form a second correction winding 49. Correction winding 47 returns to the screen end transverse winding 50 at a point 44' and correction winding 49 returns to screen end transverse winding 50 at a point 46'. Along transverse winding 50, 25 turns run through section line 45, 22 turns run through section line 51, 19 turns run through section 52, 22 turns run through section line 53 and 25 run through section line 54. The left end (FIG. 6) of transverse winding 50 separates into three longitudinal main winding sections 57, 56 and 55 having 7, 7 and 11 turns respectively. The turns of longitudinal sections 55, 56 and 57 combine at the gun end of upper coil 40 to form a gun end transverse winding 58 which includes 25 conductor turns at its center where the Y axis is crossed.

Although the yoke of FIGS. 5 and 6 is more complex than the illustration of FIGS. 2 through 4, the application of the principles of the illustration is readily apparent. That is, that one or more correction windings e.g., 47, 49 can be formed by running some of the screen end transverse turns toward the gun end of the yoke, then returning them to the screen end to cause "reverse" yoke current flow. The placement of such correction windings can be selected by the designer to provide the desired effect of the magnetic fields to be produced. Such placement can occur at any point along the screen end transverse winding section. It has been found preferable, however, to produce correction windings which are symmetrical about the Y axis as shown in FIG. 6.

While a preferred embodiment of the invention has been illustrated, it will be obvious to those skilled in the art that various modifications and changes may be made thereto without departing from the scope of the invention as defined in the appended claims.

What is claimed is:

1. A deflection arrangement for CRT comprising a source of deflection signals connected to a deflection yoke comprising a pair of windings engaged opposite one another on a neck portion of said CRT, each of said windings comprising:

a main winding comprising at least two spaced apart longitudinal sections engaged along the length of said neck, each having a plurality of turns for creating in conjunction with the other of the said pair of windings, a substantially first harmonic with associated higher harmonics magnetic field through said CRT neck, a gun end transverse section having a plurality of turns serially connecting the turns of said two longitudinal sections and a screen end transverse section having a plurality of turns serially connecting the turns of said two longitudinal sections; and an additional winding for modifying third and higher harmonic nonuniformities of the magnetic field created in said CRT neck, said additional winding comprising a plurality of turns each connected in series with one turn of said main winding and extending from said screen end transverse section toward said gun end transverse section to a predetermined location on said CRT neck and extending from said predetermined location to said screen end transverse section such that no additional winding turn crosses itself.

2. In a deflection yoke for a cathode ray tube having a neck portion, a correction winding comprising:

a plurality of serially connected turns, each turn comprising a first longitudinal section for conveying current in a first direction along said neck, a first end section transverse to said neck serially connecting said first longitudinal section to a second longitudinal section, said second longitudinal section for conveying current in a second direction opposite to said first direction along said neck, and a correction section for connecting said first longitudinal section to said second longitudinal section, said correction section comprising the serial connection of a first end portion transverse to said neck serially connecting said first longitudinal section to a third longitudinal section substantially parallel to said first longitudinal section for conveying current in said second direction along said neck, a second end portion transverse to said neck, serially connecting said third longitudinal section to a fourth longitudinal section substantially parallel to said second longitudinal section for conveying current in said first direction along said neck and a third end portion transverse to said neck, serially connecting said fourth longitudinal section to said second longitudinal section.

3. A coil for use in a deflection yoke for a cathode ray tube having a neck portion, said coil comprising:

a single conductor path series wound in a configuration having an inner surface in the shape of a surface of rotation about the longitudinal axis of said neck portion for engagement with said neck portion and including means for connection to an electrical signal source, said coil configuration comprising:

a first longitudinal section of winding comprising n turns of said conduction path for conveying current in a first direction along said neck portion when energizing by said source, a second longitudinal section of winding comprising n turns of said conduction path for conveying current in a second direction opposite to said first direction along said neck portion when energizing by said source, a third longitudinal section of winding comprising m-turns located along said surface of rotation said first longitudinal section of winding and said second longitudinal section of winding for conveying current in said second direction along said neck portion when energizing by said source, a fourth longitudinal section of winding comprising m-turns located along said surface of rotation between said third longitudinal section and said second longitudinal section for conveying current in said first direction along said neck portion when energized by said source, a plurality of turns of said conduction path transverse to said neck portion for completing the series electrical connections of said first, said second, said third and said fourth longitudinal sections of said coil, and said configuration being formed such that the total number of turns transverse to the neck between said third and said fourth longitudinal sections of winding is substantially less than $2n+2m$.

4. The coil of claim 3 wherein said third longitudinal section of winding is located between said first longitudinal section and a center line equidistant along said surface of rotation from said first and said second longitudinal winding sections and said fourth longitudinal section of winding is located between said second longitudinal section and said center line.

5. A deflection yoke comprising a pair of windings for engagement with a neck portion of a cathode ray tube each of said windings comprising:

a main winding comprising a first plurality of turns of a single conduction path having a shape for engagement with said neck portion and comprising a first and second side of substantially equal length, a first substantially arcuate end electrically connecting the turns of one end of each of said sides and a second substantially arcuate end electrically connecting the turns of the other end of said sides; and a second winding comprising a second plurality of turns of said single conduction path connected in electrical series with said first plurality of turns, said second plurality of turns running substantially parallel to the sides and first arcuate end of said main coil, and running substantially parallel to said second arcuate end for a first predetermined distance from said first side, said first predetermined distance being less than half of the arc length of said second arcuate end, then running longitudinally with said neck portion toward said first arcuate end for a second predetermined distance, running in a substantially arcuate shape transverse to said neck portion for a third predetermined distance, running longitudinally with said neck portion to said second arcuate end at said first predetermined distance from said second side and running parallel with said second arcuate end to said second side.

* * * * *